US005226871A

United States Patent [19]

Skipor

[11] Patent Number: 5,226,871

[45] Date of Patent: Jul. 13, 1993

[54] FOLDER WITH GRADUAL GUIDE ASSEMBLY AND METHOD

[75] Inventor: Eugene Skipor, Hickory Hills, Ill.

[73] Assignee: Rockwell International Corporation, Seal Beach, Calif.

[21] Appl. No.: 725,130

[22] Filed: Jul. 3, 1991

[51] Int. Cl.[5] ..... B31F 1/08; B42C 1/00

[52] U.S. Cl. ..... 493/425; 493/427; 493/429; 493/432; 270/49

[58] Field of Search ..... 270/21.1, 47–50, 270/32, 20.1; 493/424–429, 431, 432, 442–444

[56] References Cited

U.S. PATENT DOCUMENTS

| | | | |
|---|---|---|---|
| 3,096,977 | 7/1963 | Winkler et al. | 493/424 X |
| 3,758,102 | 9/1973 | Munn | 493/432 |
| 3,918,698 | 11/1975 | Coast | 493/422 |
| 4,494,949 | 1/1985 | Baley | 493/432 |
| 4,666,139 | 5/1987 | Filewich | 493/432 |
| 4,697,805 | 10/1987 | Herb | 270/47 |
| 4,807,865 | 2/1989 | Kobler et al. | 270/58 X |
| 4,817,932 | 4/1989 | Stab | 493/424 |
| 4,893,803 | 1/1990 | Peterson | 270/47 |
| 5,013,020 | 5/1991 | Stoll | 270/47 |
| 5,092,833 | 3/1992 | King et al. | 493/424 |

FOREIGN PATENT DOCUMENTS

| | | | |
|---|---|---|---|
| 111375 | 5/1991 | Japan | 493/427 |

*Primary Examiner*—Edward K. Look
*Assistant Examiner*—John Ryznic
*Attorney, Agent, or Firm*—C. B. Patti; V. L. Sewell; H. F. Hamann

[57] ABSTRACT

A folder (58) of the type having a folding cylinder (16) cooperating with a jaw cylinder (20) to cut and fold a ribbon of paper (14) into a folded product (14') provided with a guide assembly (60) with a guide surface defined by a nonconcentric guide with a convex section (64) and a convex section (74) joined together end-to-end to form a generally S-shaped or approximately cubical parabolic guide surface which conforms to the natural flow shape of the product (14') for minimum interference therewith to reduce the formation of dog-ears.

17 Claims, 2 Drawing Sheets

FOLDER WITH GRADUAL GUIDE ASSEMBLY AND METHOD

BACKGROUND OF THE INVENTION

1. Field of the Invention

This invention relates generally to paper folding apparatus of the type employing interacting rotating cylinders and specifically to a guide shoe for guiding the paper from one cylinder to the other.

2. Description of the Related Art Including Information Disclosure Under 37 CFR 1.97-1.99

Referring to FIG. 1, a known folding apparatus, or folder, 10 is shown which employs a known guide shoe assembly 12 for guiding a ribbon of paper 14 from a folding cylinder 16 mounted for clockwise rotation in the direction of arrow 18 to a jaw cylinder 20 mounted for counterclockwise rotation in the direction of arrow 22 around a center axis 24.

The ribbon 14 first passes between a cutting cylinder 26 mounted for counterclockwise rotation in the direction of arrow 28 and the folding cylinder 16. A pair of cutting knives 30 on opposite sides of the cutting cylinder 16 cuts the ribbon 14 against a plurality of cutting rubbers 32 equally spaced around the folding cylinder 16.

The cut product 14' which extends between each pair of adjacent cutting rubbers is then carried by the folding cylinder 16 past a cylindrical guide shoe 34 to a folding station 36 at the juncture, or nib, between the folding cylinder 16 and the jaw cylinder 20. A plurality of tucker blade mechanisms 38 are located midway between each of the adjacent pairs of cutting rubbers 32. Those tucker blade mechanisms 38 successively align opposite a plurality of associated movable jaw assemblies 40 at the nib when the folding cylinder 16 and jaw cylinder are rotated during operation of the folder 10. When alignment occurs, the tucker blade mechanism 38 tucks in the middle of the cut product into an elongate slot 40' of the aligned movable jaw assembly 40 which produces an elongate crease therein and holds the cut product 14' as the product 14' is rotated away from the nib. The cut product 14' is then held at the middle crease, or fold, with the free edges trailing as the product 14' is carried to a delivery fly 42 by continued rotation of the jaw cylinder 20. When it reaches the fly 42, a jaw cylinder stripper shoe 44 removes the product 14' from the jaw cylinder. The folded and cut product is then received between an adjacent pair of arms of the delivery fly 42 and conveyed thereby to stripper wheels 46. The stripper wheels 46 remove the product 14' and lay it on a delivery belt 48. The folded product 14' is then delivered by the belt 48 in a shingled stream with the folded edge forward.

When the folded product is being transferred from the folding cylinder 16 to the jaw cylinder 20, the free ends of the folded product 14' rapidly change direction as the crease held by jaw cylinder 20 is rotated upward and to the left while the free ends are still being rotated generally to the right. This causes the corners of the folded product opposite the crease to fold over and forms dog-ears in a fold out area 50. If these dog-ears are permitted to remain, they tend to cause problems in the product flow downstream of the delivery belt 48.

Accordingly, it is known to provide a guide shoe assembly 52 over the jaw cylinder 20 to reduce the formation of dog-ears. The known guide shoe 52 has a guide section 54 which is concentric with the jaw cylinder 20 and which is placed very close to the cylindrical surface of the jaw cylinder 20 by a gap on the order of 250 mils. Another guide section is defined by a curved arm 56 pivotally mounted at the inlet end of the cylindrical section 54. As seen, the angular extent 53 of the entire guide shoe assembly 52 is substantially less than the ninety degree section between the four jaw assemblies 40 and the angular extent of the cylindrical section is less than half of the total length of the guide shoes 52. Accordingly, the paper product 14' is forced to rapidly and abruptly conform to the cylindrical shape of the jaw cylinder 20. This is done based on the belief that the dog-ears can be removed by abruptly and rapidly forcing the paper into conformance with the surface of the jaw cylinder 20. However, this known guide shoe assembly 52 is often ineffective in reducing the dog-ear problem and, in fact, is believed to aggravate the problem.

SUMMARY OF THE INVENTION

It is therefore the principal object of the invention to provide a folder with a guide assembly for guiding paper from the folding cylinder to the jaw cylinder which reduces the formation of dog-ears and a method pursuant to which the paper product is gradually and gently guided to the surface of the jaw cylinder 20 without substantial interference with its natural flow shape.

This object is achieved by provision of a paper folding apparatus having a rotatable folding cylinder and a rotatable jaw cylinder with a paper engaging surface for receipt of paper from the rotatable folding cylinder with a guide assembly for guiding paper from the folding cylinder to the jaw cylinder comprising a guide member with a curved guide surface for forcing the paper from the folding cylinder onto the surface of the jaw cylinder and a pair of opposite receiving and exit ends and means for mounting the guide member relative to the jaw cylinder and the folding cylinder with the curved guide surface spaced from the surface of the jaw cylinder by a selected distance which gradually decreases from the receiving one of the opposite ends to the exit end.

This object is also achieved by providing a method of folding an elongate strip of paper with a folding apparatus having a rotatable folding cylinder and rotatable jaw cylinder with a paper engaging surface for receipt of paper from the rotatable folding cylinder comprising the steps of determining the natural flow shape of the paper in a fold-off area between the folding cylinder and the jaw cylinder and gradually guiding the paper from the fold-off area onto the surface of the jaw cylinder by means of a guide surface which generally conforms to the natural flow shape of the paper.

The objective is also achieved by provision of a paper folding apparatus having a rotatable folding cylinder and a rotatable jaw cylinder with a paper engaging surface for receipt of paper from the rotatable cylinder, a center axis and a fold-off area extending between the folding cylinder and the jaw cylinder with a guide assembly for guiding paper from the folding cylinder to the jaw cylinder comprising a guide member with a guide surface for gradually forcing the paper from the folding cylinder onto the surface of the jaw cylinder and a pair of opposite ends including a substantially cylindrical section having a center axis and means for mounting the guide member relative the jaw cylinder with the center axis of the cylindrical section of the guide surface offset from the center axis of the jaw cylinder.

BRIEF DESCRIPTION OF THE DRAWING

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENT

Figure 2:
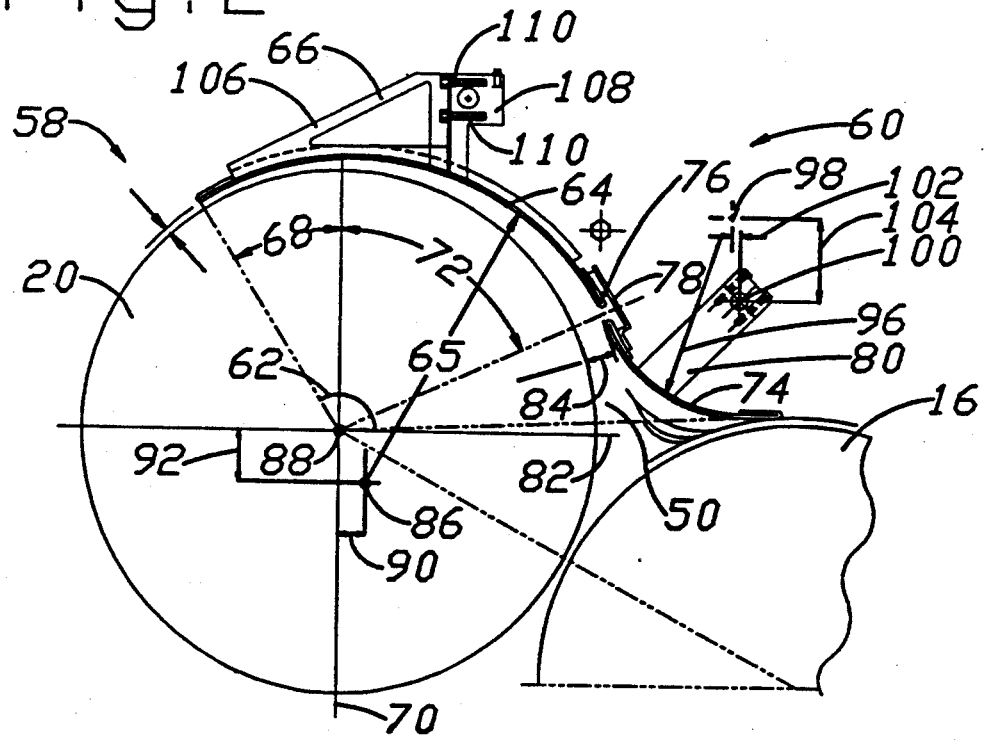
FIG. 2 is a schematic illustration of a portion of a preferred embodiment of a folder of the present invention with an improved guide shoe assembly of the present invention.

Referring now to FIG. 2, the preferred embodiment of the folder 58 of the present invention is shown in schematic form to more clearly illustrate the guide assembly 60 with the understanding that the other parts of the folder 58 are substantially the same as the folder 10 of the prior art.

Figure 1:
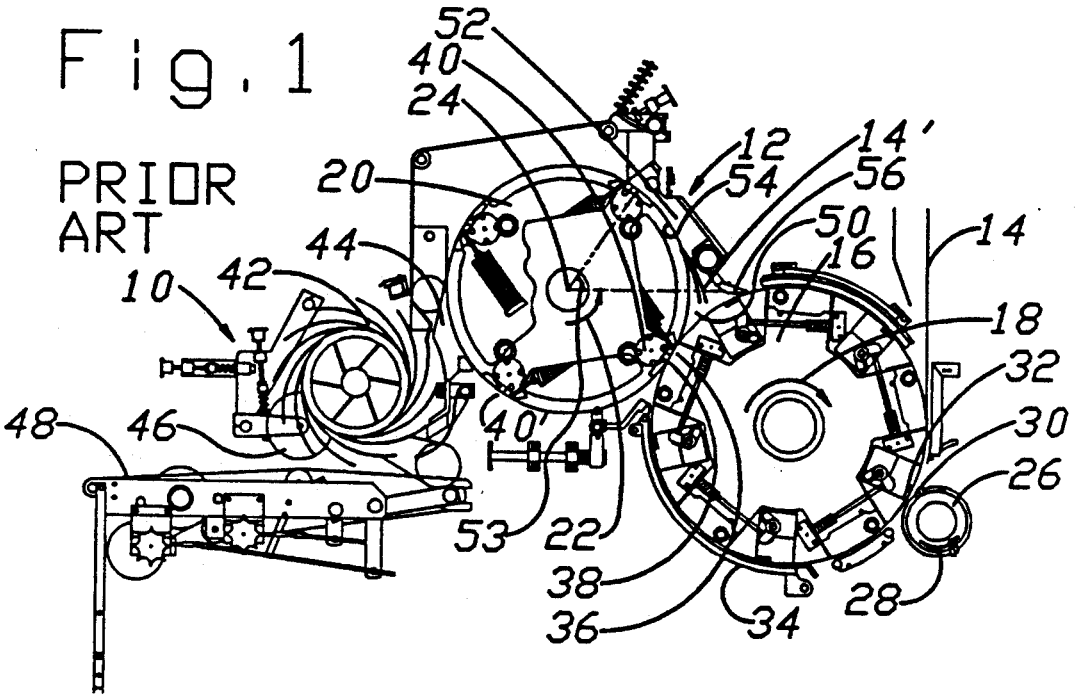
Fig. 1 PRIOR ART
FIG. 1 is a sectional side view of the folder 10 of the prior art described above.

Unlike the guide 52, the guide assembly 60 has a generally S-shaped configuration with an angular extent angle 62 which substantially exceeds that of the angular extent 53 of the guide assembly 52 of FIG. 1. More specifically, the angular extent 62 substantially exceeds the ninety degree separation between jaw assemblies 40. A first section 64 is held in position by a mounting bracket assembly 66 and has an angular extent 68 to the left of the vertical axis 70 of approximately twenty-eight degrees, while the angular extent 72 to the right of the vertical 70 is approximately sixty-eight degrees.

A second cylindrical section 74 is cantilever mounted to a receiving end of the first section 64 by means of a plurality of mounting pegs 76 releasably fitted through mating holes in a mounting bracket 78 attached to the second section 74 and a pivotally mounted bracket assembly 80. The second section 74 extends almost to the surface of the folding cylinder 16 adjacent horizontal axis 82 of the jaw cylinder 20.

Another significant feature is the distance 84 between the surface of the jaw cylinder 20 at the surface of guide section 76 which gradually decreases from a maximum of approximately 3.608 inches at the receiving end to a minimum of approximately 0.249 inches at the exit end adjacent the surface of the jaw cylinder 20. This gradual variation preferably results in a crescent shaped gap between the section 64 and the jaw cylinder 20 defined by the intersection of two circles.

The guide surface of guide section 64 is cylindrical with a radius 65 of approximately seventeen inches while the radius of the jaw cylinder is approximately 13.750 inches. Unlike the guide assembly 52, these two cylindrical surfaces are not concentric. Instead the axis 86 of the cylindrical section 64 is offset by a distance 90 to the right of the axis 88 of the jaw cylinder 20 by approximately 1.628 inches and is offset beneath the axis 88 by a distance 92 of approximately 2.694 inches.

The second section is also formed as part of a cylinder having a radius 96 of approximately ten inches with a center axis 98 on the opposite side of the guide surface as shown to form a concave surface for section 74 as opposed to the convex surface of section 64. With these two cylindrical sections joined end to end, they have a generally S-shaped configuration which is also approximately cubical parabolic, $y=x^3$, where x is small.

The center axis 98 is offset to the left of the pivot axis of the mounting bracket 80 by an approximate distance 102 of 0.514 inches and above by an approximate distance 104 of approximately 3.705 inches. With this relative relationship the guide section 74 can be lifted off of pegs 76 and pivoted away for access to the fold-off area 50. Likewise, the mounting bracket assembly 66 has a triangular member 106 which is mounted in a fixed position to which is adjustably mounted an L-shaped bracket 108. Bracket 108 is secured to the top of the first section 64 by means of a pair of bolts 110 and 112 fitted through slots to enable the L-shaped bracket 108 and the section 64 to be selectively raised and lowered.

The shape of guide assembly 60 generally conforms to the natural flow shape of the folded product 14'. The natural flow shape is the shape the flexible product assumes while being rotated through the fold-off area without interference or disturbance. It has been determined that this shape is influenced by a centrifugal radial force vector as well as by an air force vector acting along the length of the product 14' The centrifugal force vector tends to lift the product off the cylinder surface while the air resistance force vector combs the product back down onto the cylinder. The addition of these vectors impose an approximately cubical parabolic shape onto the product 14'.

The guide assembly 60 with the shape approximating the natural flow shape of the product is placed relative to the jaw cylinder 20 and the folding cylinder 16 to conform to the natural shape of the product 14' and spaced from its normal path in the fold-off area 50 to minimize disturbance of the natural flow shape in the fold-off area while still gradually and gently forcing it into contact with the surface of the jaw cylinder 20. It has been found that the less disturbance to the natural flow shape, the less tendency there is for dog-ears to form.

Thus, the method of the present invention includes the steps of determining the natural flow shape of the paper in a fold-off area between the folding cylinder and the jaw cylinder and then gradually guiding the paper from the fold-off area onto the surface of the jaw cylinder by means of a guide surface which generally conforms to the natural flow shape of the paper. The natural flow shape is performed by the steps of operating the folding apparatus with substantially no interference with the shape assumed by the paper in the fold-off area, observing the assumed shape, and making measurements of the assumed shape. Generally, the guide surface is formed with a configuration and dimensions determined in accordance with measurements of the natural flow shape of the paper assumed during operation of the folding apparatus when there is substantially no interference with the natural flow shape of the paper. The guide assembly 60 is mounted spaced from the jaw cylinder 20 and the folding cylinder 16 to gradually force the paper onto the surface of the jaw cylinder 20 without substantially disturbing the natural flow shape of the paper product 14' in the fold-off area 50. The paper is thereby guided from the folding cylinder 16 to the jaw cylinder 20 along a generally S-shaped configuration. Preferably, the paper is guided through substantially the entire fold-off area 50. After the guide assembly 60 is mounted at an initial location relative to the jaw cylinder 20, the folding apparatus 58 is operated to determine whether the guide member interferes with the natural flow shape of the paper product 14'. The mounting location of the guide assembly 60 is then adjusted until it ceases to substantially interfere with the natural flow shape of the paper product 14'.

Figure 3B:
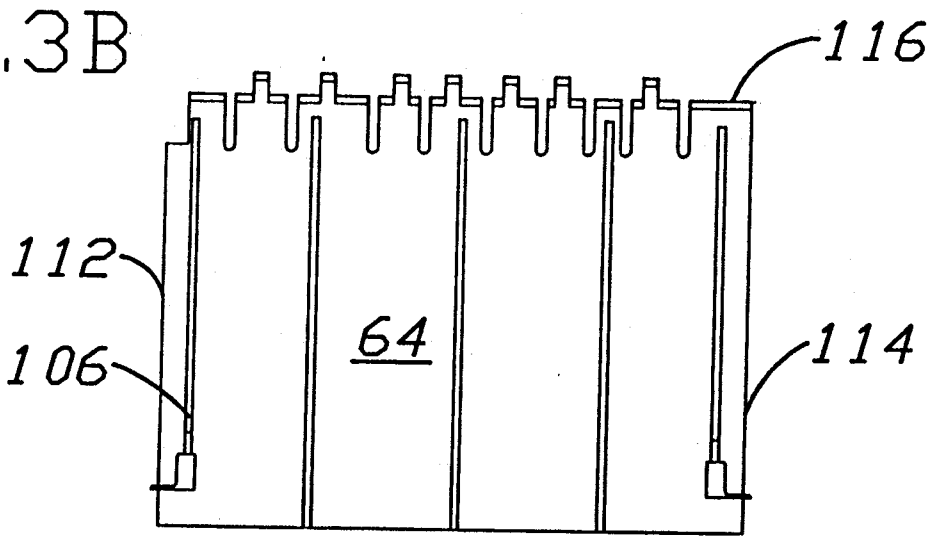
FIG. 3B is a plan view of the cylindrical section of the guide shoe of FIG. 3A.
Figure 3C:
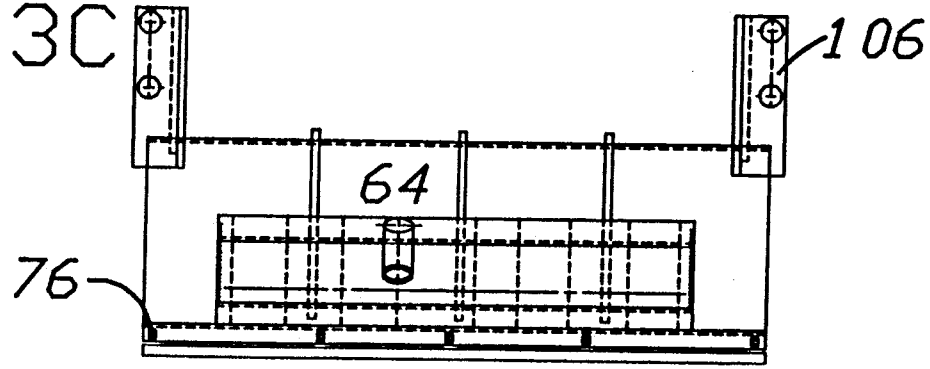
FIG. 3C is a front view of the cylindrical section of FIG. 3B.
Figure 3A:
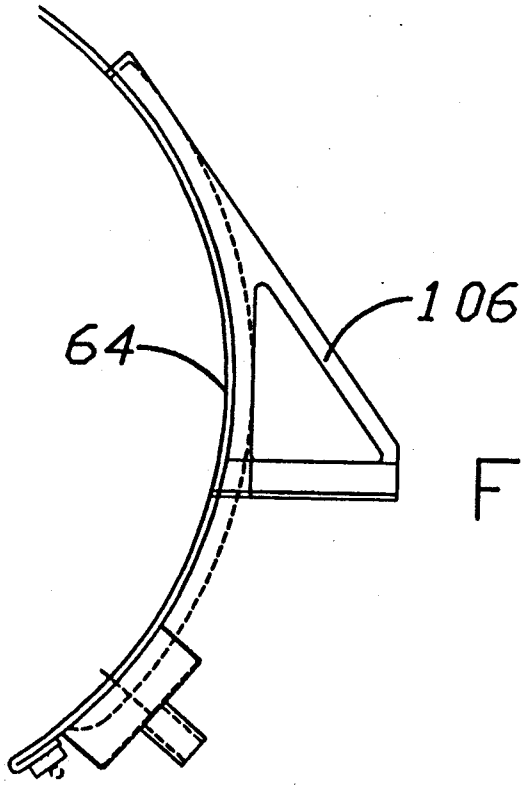
FIG. 3A is a side view of a cylindrical section of the guide shoes of FIG. 2 apart from the folder.

Referring to FIGS. 3A, 3B and 3C, the guide 64 is seen to provide a substantially continuous surface across the length of the jaw cylinder 20 and preferably comprises a sheet of metal extending between opposite sides 112 and 114. At the exit end 116, preferably, comb teeth 118 intermediate slots 120 are provided.

While a detailed description of the preferred embodiment of the invention has been given, it should be appreciated that many variations can be made thereto without departing from the scope of the invention as set forth in the appended claims.

What is claimed is:

1. In a paper folding apparatus having a rotatable folding cylinder and a rotatable jaw cylinder with a paper engaging surface for receipt of paper from the rotatable folding cylinder, the improvement being a guide assembly for guiding paper from the folding cylinder to the jaw cylinder, comprising:

a guide member with a curved guide surface for smoothly forcing the paper from the folding cylinder onto the surface of the jaw cylinder which extends substantially entirely across a fold-off area between the folding cylinder and the jaw cylinder and a pair of opposite receiving and exit ends; and means for mounting the guide member relative to the jaw cylinder and the folding cylinder with the exit end sufficiently near the surface of the jaw cylinder to force the paper onto the surface of the jaw cylinder and with the curved guide surface extending from the exit end and being spaced from the surface of the jaw cylinder by a selected distance which gradually decreases from the receiving one of the opposite ends to the exit end.

2. In a paper folding apparatus having a rotatable folding cylinder and a rotatable jaw cylinder with a paper engaging surface for receipt of paper from the rotatable folding cylinder, the improvement being a guide assembly for guiding paper from the folding cylinder to the jaw cylinder, comprising:

a guide member with a generally S-shaped curved guide surface for smoothly forcing the paper from the folding cylinder onto the surface of the jaw cylinder and a pair of opposite receiving and exit ends; and means for mounting the guide member relative to the jaw cylinder and the folding cylinder with the exit end sufficiently near the surface of the jaw cylinder to force the paper onto the surface of the jaw cylinder and with the curved guide surface extending from the exit end and being spaced from the surface of the jaw cylinder by a selected distance which gradually decreases from the receiving one of the opposite ends to the exit end.

3. In a paper folding apparatus having a rotatable folding cylinder and a rotatable jaw cylinder with a paper engaging surface for receipt of paper from the rotatable folding cylinder, the improvement being a guide assembly for guiding paper from the folding cylinder to the jaw cylinder, comprising:

a guide member with a curved guide surface for smoothly forcing the paper from the folding cylinder onto the surface of the jaw cylinder and in which as least part of the guide surface has an approximately cubical parabolic shape and a pair of opposite receiving and exit ends; and means for mounting the guide member relative to the jaw cylinder and the folding cylinder with the exit end sufficiently near the surface of the jaw cylinder to force the paper onto the surface of the jaw cylinder and with the curved guide surface extending from the exit end and being spaced from the surface of the jaw cylinder by a selected distance which gradually decreases from the receiving one of the opposite ends to the exit end.

4. In a paper folding apparatus having a rotatable folding cylinder and a rotatable jaw cylinder with a paper engaging surface for receipt of paper from the rotatable folding cylinder, the improvement being a guide assembly for guiding paper from the folding cylinder to the jaw cylinder, comprising:

a guide member with a curved guide surface for smoothly forcing the paper from the folding cylinder onto the surface of the jaw cylinder and a pair of opposite receiving and exit ends, during operation the paper naturally assuming a natural flow shape between the folding cylinder and the jaw cylinder and said curved guide surface having a shape which generally conforms to the natural flow shape of the paper; and means for mounting the guide member relative to the jaw cylinder and the folding cylinder with the exit end sufficiently near the surface of the jaw cylinder to force the paper onto the surface of the jaw cylinder and with the curved guide surface extending from the exit end and being spaced from the surface of the jaw cylinder by a selected distance which gradually decreases from the receiving one of the opposite ends to the exit end.

5. In a paper folding apparatus having a rotatable folding cylinder and a rotatable jaw cylinder with a paper engaging surface for receipt of paper from the rotatable folding cylinder, the improvement being a guide assembly for guiding paper from the folding cylinder to the jaw cylinder, comprising:

a guide member with a curved guide surface for smoothly forcing the paper from the folding cylinder onto the surface of the jaw cylinder and a pair of opposite receiving and exit ends; and means for mounting the guide member relative to the jaw cylinder and the folding cylinder with the exit end sufficiently near the surface of the jaw cylinder to force the paper onto the surface of the jaw cylinder and with the curved guide surface extending from the exit end and being spaced from the surface of the jaw cylinder by a selected distance which gradually decreases from the receiving one of the opposite ends to the exit end including means for selectively adjusting the position of the guide surface relative to the folding cylinder and the jaw cylinder.

6. In a paper folding apparatus having a rotatable folding cylinder and a rotatable jaw cylinder with a paper engaging surface for receipt of paper from the rotatable folding cylinder, the improvement being a guide assembly for guiding paper from the folding cylinder to the jaw cylinder, comprising:

a guide member with a curved guide surface for smoothly forcing the paper from the folding cylinder onto the surface of the jaw cylinder and a pair of opposite receiving and exit ends, the curved guide surface is spaced from the folding cylinder to form a gap which has a preselected, substantially continuous configuration; and means for mounting the guide member relative to the jaw cylinder and the folding cylinder with the exit end sufficiently near the surface of the jaw cylinder to force the paper onto the surface of the jaw cylinder and with the curved guide surface extending from the exit end and being spaced from the surface of the jaw cylinder by a selected distance which gradually decreases from the receiving one of the opposite ends to the exit end including means for selectively adjusting said configuration.

7. In a paper folding apparatus having a rotatable folding cylinder and a rotatable jaw cylinder with a paper engaging surface for receipt of paper from the rotatable cylinder and a center axis and a fold-off area extending between the folding cylinder and the jaw cylinder, the improvement being a guide assembly for guiding paper from the folding cylinder to the jaw cylinder, comprising:

a guide member with a guide surface for gradually forcing the paper from the folding cylinder onto the surface of the jaw cylinder and a pair of opposite ends including a substantially cylindrical section having a center axis, another generally cylindrical section at the end of the substantially cylindrical section to generally define an approximately cubical parabolic shape for the guide member, and means for releasably interconnecting the cylindrical sections together; and means for mounting the guide member relative the jaw cylinder with the center axis of the cylindrical section of the guide surface offset from the center axis of the jaw cylinder.

8. In a paper folding apparatus having a rotatable folding cylinder and a rotatable jaw cylinder with a paper engaging surface for receipt of paper from the rotatable cylinder and a center axis and a fold-off area extending between the folding cylinder and the jaw cylinder, the improvement being a guide assembly for guiding paper from the folding cylinder to the jaw cylinder, comprising:

a guide member with a guide surface for smoothly forcing the paper from the folding cylinder onto the surface of the jaw cylinder and a pair of opposite ends including a substantially cylindrical section with a center axis, another generally cylindrical section at the end of the substantially cylindrical section to generally define a cubical parabolic shape for the guide member, and means for releasably interconnecting the cylindrical sections together, the substantially cylindrical section and the other cylindrical section being interconnected to form a generally cubical parabolic shaped guide surface; and means for mounting the guide member relative the jaw cylinder with the center axis of the cylindrical section of the guide surface offset from the center axis of the jaw cylinder.

9. In a paper folding apparatus having a rotatable folding cylinder and a rotatable jaw cylinder with a paper engaging surface for receipt of paper from the rotatable cylinder and a center axis and a fold-off area extending between the folding cylinder and the jaw cylinder, the improvement being a guide assembly for guiding paper from the folding cylinder to the jaw cylinder, comprising:

a guide member having an angular extend greater than ninety degrees with a guide surface for smoothly forcing the paper from the folding cylinder onto the surface of the jaw cylinder and a pair of opposite ends including a substantially cylindrical section having a center axis; and means for mounting the guide member relative the jaw cylinder with the center axis of the cylindrical section of the guide surface offset from the center axis of the jaw cylinder.

10. In a paper folding apparatus having a rotatable folding cylinder and a rotatable jaw cylinder with a paper engaging surface for receipt of paper from the rotatable cylinder and a center axis and a fold-off area extending between the folding cylinder and the jaw cylinder, the improvement being a guide assembly for guiding paper from the folding cylinder to the jaw cylinder, comprising:

a guide member with a guide surface for smoothly forcing the paper from the folding cylinder onto the surface of the jaw cylinder and a pair of opposite ends including a substantially cylindrical section having a center axis, the jaw cylinder having a plurality of gripping jaws angularly spaced around a cylindrical surface of the jaw cylinder and the guide member having an angular extent greater than said angular spacing; and means for mounting the guide member relative the jaw cylinder with the center axis of the cylindrical section of the guide surface offset from the center axis of the jaw cylinder.

11. A method of folding an elongate strip of paper with a folding apparatus having a rotatable folding cylinder and rotatable jaw cylinder with a paper engaging surface for receipt of paper from the rotatable folding cylinder, comprising the steps of:

determining the natural flow shape of the paper in a fold-off area between the folding cylinder and the jaw cylinder; and gradually guiding the paper from the fold-off area onto the surface of the jaw cylinder by means of a guide surface which generally conforms to the natural flow shape of the paper.

12. The method of claim 11 and with said step of determining the natural flow shape is performed by the steps of operating the folding apparatus with substantially no interference with the shape assumed by the paper in the fold-off area, observing the assumed shape, and making measurements of the assumed shape.

13. The method of claim 11 in which the guide surface is formed with a configuration and dimensions determined in accordance with measurements of the natural flow shape of the paper assumed during operation of the folding apparatus when there is substantially no interference with the natural flow shape of the paper.

14. The method of claim 13 in which said step of guiding includes the step of mounting the guide member spaced from the jaw cylinder and the folding cylinder to gradually force the paper onto the surface of the jaw cylinder without substantially disturbing the natural flow shape of the paper in the fold-off area.

15. The method of claim 11 in which the step of guiding includes the step of guiding the paper from the folding cylinder to the jaw cylinder along a generally S-shaped configuration.

16. The method of claim 11 in which said step of guiding includes the step of guiding the paper through substantially the entire fold-off area.

17. The method of claim 11 in which said step of guiding includes the steps of mounting the guide member at an initial location relative to the jaw cylinder, operating the folding apparatus to determine whether the guide member interferes with the natural flow shape of the paper, and adjusting the mounting location of the guide member until it ceases to substantially interfere with the natural flow shape of the paper.

* * * * *